US009192027B1

(12) United States Patent
Pistilli et al.

(10) Patent No.: US 9,192,027 B1
(45) Date of Patent: Nov. 17, 2015

(54) LUMINAIRE AND RELATED METHODS TO CONTROL LIGHT OUTPUT DEPENDENT UPON TEMPERATURE

(71) Applicant: DELTA T CORPORATION, Lexington, KY (US)

(72) Inventors: Antonio Pistilli, Lexington, KY (US); Isaac Fedyniak, Lexington, KY (US)

(73) Assignee: DELTA T CORPORATION, Lexington, KY (US)

( * ) Notice: Subject to any disclaimer, the term of this patent is extended or adjusted under 35 U.S.C. 154(b) by 0 days.

(21) Appl. No.: 14/558,177

(22) Filed: Dec. 2, 2014

Related U.S. Application Data

(60) Provisional application No. 61/910,615, filed on Dec. 2, 2013.

(51) Int. Cl.
*H05B 37/02* (2006.01)
*H05B 33/08* (2006.01)

(52) U.S. Cl.
CPC ..... *H05B 37/0227* (2013.01); *H05B 33/0854* (2013.01)

(58) Field of Classification Search
CPC ..... H05B 37/0227; H05B 33/0854
USPC ..... 315/113, 150, 294, 307
See application file for complete search history.

(56) References Cited

U.S. PATENT DOCUMENTS

| | | | | |
|---|---|---|---|---|
| 6,621,239 | B1 * | 9/2003 | Belliveau | 315/312 |
| 2005/0276053 | A1 * | 12/2005 | Nortrup et al. | 362/294 |
| 2007/0242461 | A1 * | 10/2007 | Reisenauer et al. | 362/294 |
| 2012/0323382 | A1 * | 12/2012 | Kamel et al. | 700/286 |
| 2014/0139122 | A1 * | 5/2014 | Valois et al. | 315/165 |
| 2014/0246993 | A1 * | 9/2014 | Catalano et al. | 315/312 |
| 2015/0002025 | A1 * | 1/2015 | Maricic et al. | 315/151 |

* cited by examiner

*Primary Examiner* — Don Le
(74) *Attorney, Agent, or Firm* — King & Schickli, PLLC

(57) ABSTRACT

A luminaire includes a fixture including at least one light source, a power supply mounted to the fixture for supplying power to the light source, and circuitry in communication with the power supply for controlling the power supplied to the light source dependent upon an ambient temperature, such that the power supplied to the light source is reduced when the ambient temperature falls below the threshold ambient temperature in order to limit the power supplied to the light source while an output of the light source remains substantially constant despite the limited power supplied. A system for indicating when maintenance is required on one or more luminaires in a building by sensing ambient temperatures and determining a difference between the ambient temperatures sensed and providing an indication signal that the determined difference between the ambient temperatures is at or above a threshold difference.

20 Claims, 3 Drawing Sheets

LUMINAIRE AND RELATED METHODS TO CONTROL LIGHT OUTPUT DEPENDENT UPON TEMPERATURE

TECHNICAL FIELD

This application relates to the lighting arts and, in particular, a luminaire.

BACKGROUND

Luminaires or lighting fixtures are used for providing artificial light where needed, such as in buildings or outdoor areas. A typical arrangement includes a plurality of light sources carried in a single, elongated fixture and arranged in tandem for lighting a particularly wide area, such as an open floor space in a warehouse or an office space. While this type of lighting generally performs without incident due in part to the utilization of adequate heat sinks, controlling the power supplied to the plurality of light sources dependent upon an ambient temperature can extend the useful life of the plurality of light sources. Taking measures to insure the proper functioning of the heat sinks can likewise extend the useful life of the plurality of light sources.

In a first instance, the useful life can be extended by limiting the possibility for heat related damage that can arise from exposure to an ambient temperature in a range sufficient to cause damage to the plurality of light sources.

In a second instance, the useful life of the plurality of light sources can be extended by reducing the power supplied to the plurality of light source when an ambient temperature is below a threshold ambient temperature while maintaining an output of the plurality of light sources at a substantially constant level.

In a third instance, the useful life of the plurality of light sources can be extended by monitoring ambient temperatures within the lighting fixture and at a second position apart from the fixture to insure proper functioning of the heat sinks. A significant difference between the monitored ambient temperatures could indicate that the heat sink requires maintenance or cleaning.

Accordingly, a need is identified for an improved luminaire that provides the ability to extend the useful life of the plurality of light sources by controlling the power supplied to the plurality of light sources dependent upon an ambient temperature. This may be accomplished by limiting the possibility for heat related damage and reducing the power supplied to the plurality of light sources for greater efficiency at lower ambient temperatures. The ability to control the power supplied to the plurality of lights sources is of heightened importance in enclosed spaces such as warehouses, factories, or other industrial establishments. Even more, the useful life may be extended by monitoring ambient temperatures to insure proper functioning of heat sinks associated with the luminaire. The luminaire would be simple in construction, and could be adjusted in a variety of manners in order to achieve the desired objectives of controlled lighting. Related improvements are also proposed.

SUMMARY

In one aspect, this disclosure relates to a luminaire, comprising a fixture including at least one light source, a power supply mounted to the fixture for supplying power to the at least one light source, and circuitry in communication with the power supply for controlling the power supplied to the at least one light source dependent upon an ambient temperature. According to this aspect of the disclosure, the power supplied to the at least one light source is reduced when the ambient temperature falls below a threshold ambient temperature.

The circuitry in communication with power supply may be mounted to or near one of the power supply, the fixture, and a circuit board supporting the at least one light source. An output of the at least one light source may remains substantially constant despite the limited power supplied to the at least one light source due to the ambient temperature. The circuitry may include includes a dimmer circuit, which may comprise a fixed resistor and a variable resistor having a temperature dependent resistance. The values of the fixed resistor and the variable resistor are selected such that the power supplied to the at least one light source is reduced when the ambient temperature falls below the threshold ambient temperature. The variable resistor may be a thermistor, and the dimmer circuit may be mounted on a printed circuit board and may be an integral part of the power supply. The values of the fixed resistor and the variable resistor may be selected such that the power supplied to the at least one light source is reduced when the ambient temperature rises above the threshold ambient temperature. The power supply may be an inverter, and may provide a constant current to the at least one light source.

The power supply and circuitry in communication with the power supply may be positioned within an enclosure mounted to the fixture. The luminaire may further comprise a heat sink thermally connected to at least the at least one light source. The heat sink may be thermally connected to at least the power supply.

The circuitry in communication with the power supply controls the power supplied to the at least one light source in a linear manner. The power supply may control the power supplied to the at least one light source in a digital manner by making a step reduction in the power supplied dependent upon the ambient temperature.

A further aspect of the disclosure relates to a method of controlling power supplied to at least one light source of a luminaire. The method comprises supplying power to the at least one light source, sensing an ambient temperature, determining when the ambient temperature passes a threshold ambient temperature, and reducing the power supplied to the at least one light source when the ambient temperature falls below the threshold ambient temperature.

Still a further aspect of this disclosure relates to a system for indicating when maintenance is required on one or more luminaires in a building. The system comprises at least one luminaire, a thermal sensor mounted to the luminaire for sensing an ambient temperature within or adjacent the luminaire, a second thermal sensor mounted within the building apart from the at least one luminaire, a controller for determining a difference between the ambient temperatures sensed by the thermal sensor and the second thermal sensor; and a signal generator providing an indication signal that the determined difference between the ambient temperatures is at or above a threshold difference.

Yet a further aspect of the disclosure pertains to a system for testing efficiency of air flow cooling on one or more luminaires in a building. The system comprises at least one luminaire, a thermal sensor for sensing an ambient temperature within or adjacent the luminaire; a second thermal sensor mounted within the building apart from the at least one luminaire; and a controller for determining a difference between the ambient temperatures sensed by the thermal sensor and the second thermal sensor.

BRIEF DESCRIPTION OF THE DRAWING FIGURES

DETAILED DESCRIPTION

Figure 1:
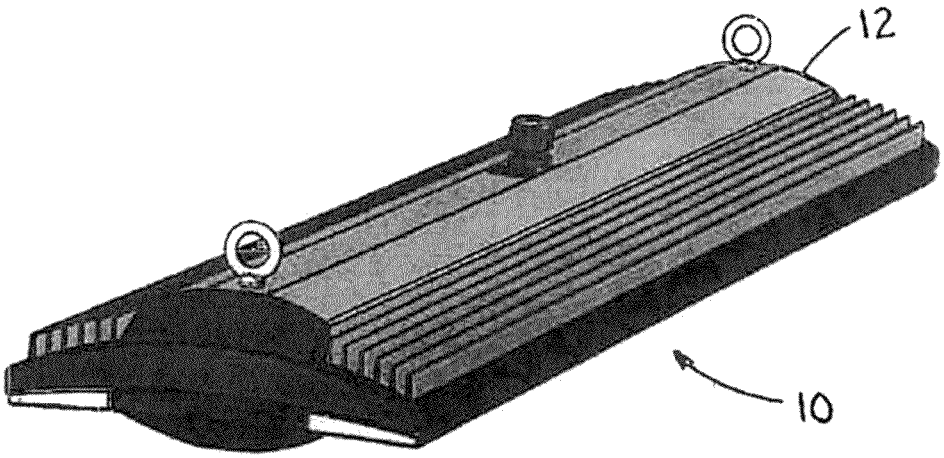
FIG. 1 is a top perspective view of a luminaire.

Reference is now made to FIG. 1, which illustrates one embodiment of a luminaire 10. The luminaire 10 includes a fixture 12 for housing a plurality of light sources 14, such as light-emitting diodes, or LEDs. In the illustrated embodiment, the light sources 14 comprise four separate arrangements of one or more LEDs, arranged in tandem on each side of the lighting fixture 10. The disclosure is not limited, however, to any particular arrangement or type of lights or light sources, and may have applicability in other arrangements, without limitation.

Figure 2:
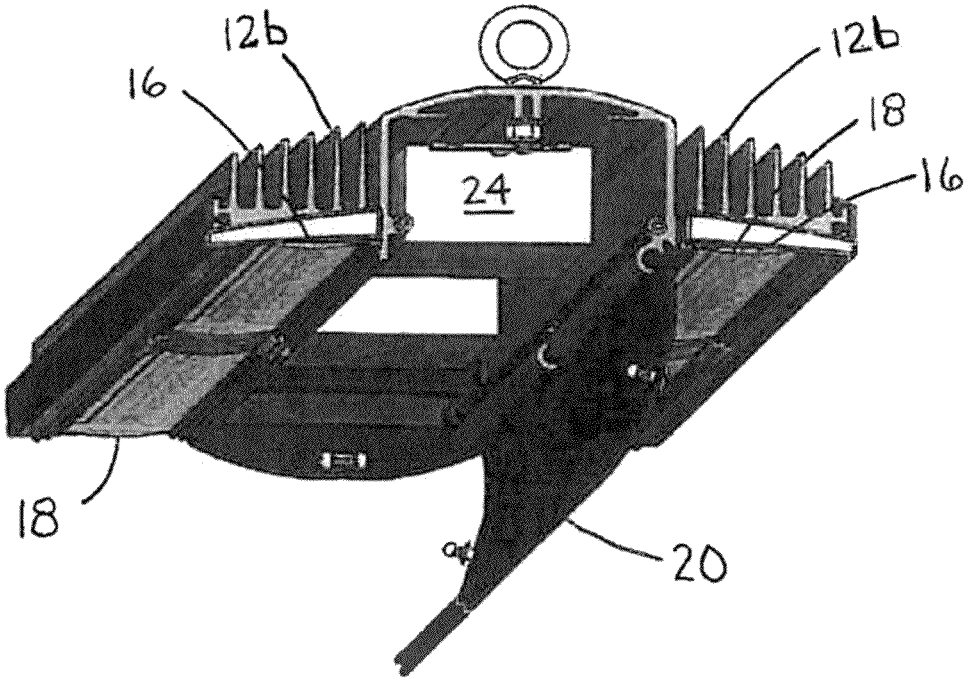
FIG. 2 is a bottom perspective view of a luminaire.

As best shown with reference to FIG. 2, the light sources 14 may be positioned in individual compartments 16 associated with at least partially translucent portions, which are termed lenses 18 for purposes of this disclosure, but may also be referred to as trays. In the illustrated embodiment, the lenses 18 each comprise elongated pieces of a relatively lightweight material, such as plastic (e.g., acrylic), arranged to substantially cover and contain the light sources 14 in the respective compartments 16. The lenses 18, however, could also be made of glass as well, or glass or plastic may be providing in combination with different materials (e.g., metal, composites, etc.). The lenses 18 need not be entirely translucent, and may comprise combinations of translucent, transparent, or opaque materials. Each lens 18 may be independently mounted to the fixture 12, and thus may be individually removable.

As further shown in FIG. 2, the fixture 12 may include a single metal extrusion, which may include heat dissipation structures or heat sinks, such as fins 12*b*. A door 20 may also be provided for providing access to components within the fixture 12, such as one or more power supplies 22, which may be in the form of inverters. The power supply 22 may be mounted directly in contact with the extrusion, such as in an interior chamber, in order to help dissipate any excess heat generated as the result of powering the light source or light sources in the luminaire 10. The power supply may also be positioned within an enclosure 24 mounted to the fixture 12.

Figure 3:
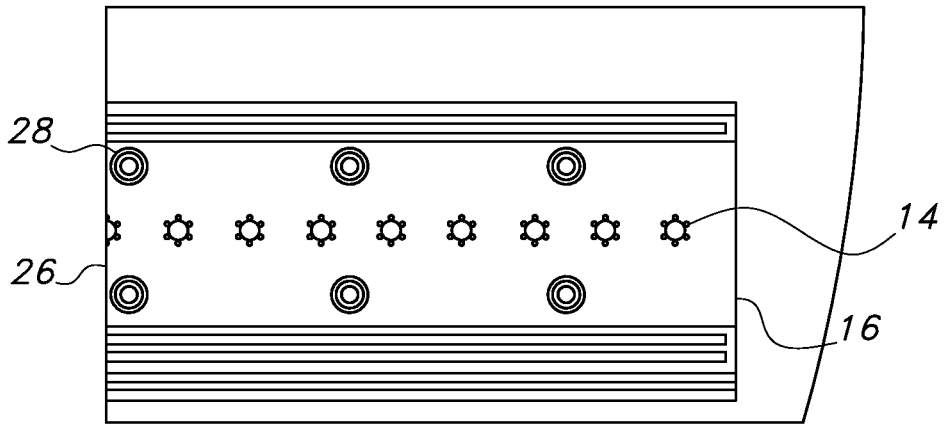
FIG. 3 is a partially cutaway bottom view of the luminaire.

As shown in FIG. 3, the light sources 14 are mounted to a circuit board 26 which is secured within one of the individual compartments 16. In this embodiment, the light sources 14 are arranged in a straight line and the circuit board 26 is secured to the fixture 12 with screws 28. The circuit board 26 may be thermally coupled to the heat sinks 12*b*.

Figure 4:
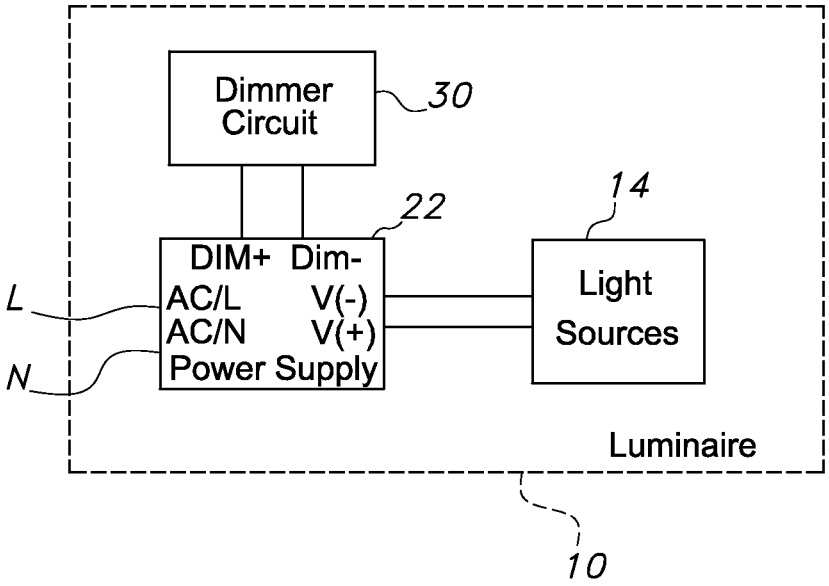
FIG. 4 is a schematic view of circuitry for the luminaire.

FIG. 4 shows a schematic diagram of circuitry for controlling the power supplied to the light sources 14 dependent upon an ambient temperature. More specifically, the power supplied to the light sources 14 may be reduced when the ambient temperature passes a threshold ambient temperature. In a first instance, the power supplied to the light sources 14 may be reduced when the ambient temperature rises above a threshold ambient temperature in order to limit adverse effects on the light sources due to heat. In a second instance, the power supplied to the light sources 14 may be reduced when the ambient temperature falls below a threshold ambient temperature in order to limit the power supplied to the light sources. In this second instance, an output of the light sources remains substantially constant despite the limited power supplied to the light sources due to the lower ambient temperature.

In the illustrated embodiment, the circuitry for controlling the power supplied to the light sources 14 dependent upon an ambient temperature includes a dimmer circuit 30. The dimmer circuit 30 may include passive components or active components (e.g., operational amplifiers). In this instance, the dimmer circuit 30 is connected to an input/output of power supply 22 and includes passive components including a fixed resistor in series with a variable resistor having a temperature dependent resistance. The variable resistor is a thermistor which changes its resistance with changes in ambient temperature. The thermistor may be a positive temperature coefficient thermistor with a resistance that increases as the ambient temperature increases, or a negative temperature coefficient thermistor with a resistance that decreases as the ambient temperature increases.

The values of the fixed resistor and the thermistor are selected such that the power supplied to the light sources 14 is reduced when the ambient temperature rises above the threshold ambient temperature. In this embodiment, the power supplied to the light sources 14 is reduced in order to limit adverse effects on the light sources due to heat. In a second embodiment, the values of the fixed resistor and the thermistor are selected such that the power supplied to the light sources 14 is reduced when the ambient temperature falls below a threshold ambient temperature in order to limit the power supplied to the light sources. In this embodiment, the output of the light sources 14 remains substantially constant despite the limited power supplied to the light sources due to the lower ambient temperature.

The dimmer circuit 30 is mounted on a circuit board in communication with the power supply 22 and may be mounted to or near one of the power supply, the fixture 12, and the circuit board 24. Alternatively, the dimmer circuit 30 may be mounted on the circuit board 24 with the light sources 14, or may be an integral part of a power supply.

In operation, power (e.g., 110/220 VAC), designated AC/L and AC/N, is provided to power supply 22. As described above, the dimmer circuit 30, including the fixed resistor in series with thermistor, is electrically connected to a dimmer circuit input (DIM +)/output (DIM −) of power supply 22. Dependent upon the ambient temperature, the resistance of the thermistor varies and the combined resistance of the fixed resistor and thermistor varies which determines the output power or current of the power supply 22. Although the output power of the power supply 22 may vary, the power supply provides a constant current to the light sources 14 via V(+) and V(−). Depending on the power supply 22 or other means, the power supplied to the lights sources 14 may be controlled in various manners. The power supplied may be controlled in a linear manner by linearly reducing the power supplied in relation to the ambient temperature after the ambient temperature passes the threshold ambient temperature, or may be controlled in a digital manner by making a step reduction in the power supplied dependent upon the ambient temperature after the ambient temperature passes the threshold ambient temperature.

In other words, different curves/functions can be implemented to control the power supplied to the light sources 14. This may be done using a combination of linear and non-linear functions. For example, a linear reduction may occur for a period of time or an amount of ambient temperature reduction, and then an exponential reduction may occur to seventy percent of maximum power. Then, if the temperature reaches a certain threshold, further reduction of the power supplied may be implemented in an aggressive manner. In addition to controlling the power supplied, the timing of such events can likewise be controlled.

In operation, power (e.g., 110/220 VAC), designated AC/L and AC/N, is provided to power supply 22. As described above, the dimmer circuit 30, including the fixed resistor in series with thermistor, is electrically connected to a dimmer circuit input (DIM +)/output (DIM −) of power supply 22. Dependent upon the ambient temperature, the resistance of the thermistor varies and the combined resistance of the fixed resistor and thermistor varies which determines the output power or current of the power supply 22. Although the output power of the power supply 22 may vary, the power supply provides a constant current to the light sources 14 via V(+) and V(−).

Figure 5:
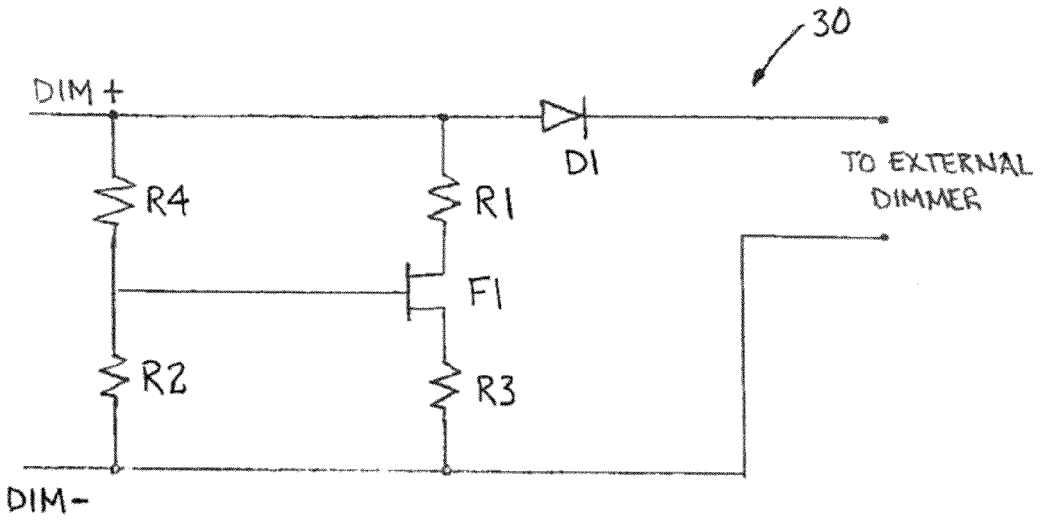
FIG. 5 is a circuit diagram relating to a dimmer circuit.

In an alternate embodiment shown schematically in FIG. 5, the dimmer circuit 30 is again connected to an input/output of power supply 22 and includes a fixed resistor R2 in series with a variable resistor R4 having a temperature dependent resistance. The variable resistor R4 is a thermistor which changes its resistance with changes in ambient temperature. The values of the fixed resistor R2 and the thermistor R4 are selected such that the power supplied to the light sources 14 is reduced when the ambient temperature rises above the threshold ambient temperature.

In one embodiment, the power supplied to the light sources 14 is reduced in order to limit adverse effects on the light sources due to heat. In another embodiment, the values of the fixed resistor and the thermistor are selected such that the power supplied to the light sources 14 is reduced when the ambient temperature falls below a threshold ambient temperature in order to limit the power supplied to the light sources. In this other embodiment, the output of the light sources 14 remains substantially constant despite the limited power supplied to the light sources due to the lower ambient temperature.

The alternate dimmer circuit 30 further includes a field effect transistor (FET) F1, second and third fixed resistors R1 and R3, and a diode D1. Together, these components allow for operation of the dimmer circuit 30 with an external dimmer (not shown) without impeding the primary operation of the dimmer circuit, namely, limiting the power supplied to the light sources 14. In use, the fixed resistor R2 in conjunction with the thermistor R4 determines when the FET F1 turns on which allows current to flow through fixed resistor R1. By choosing the fixed resistor R2 and thermistor R4, the light sources are dimmed in sequence with fixed resistor R1.

The components further allow for operation of the dimmer circuit 30 such that the reduction in power supplied to the light sources 14 can be customized to follow a flexible attenuation based on ambient temperature. In this manner, life data can be added once temperature data is compiled from the location that will be using the fixture 12.

As in the first described embodiment, the dimmer circuit 30 may be mounted on a circuit board in communication with the power supply 22 and may be mounted to or near one of the power supply, the fixture 12, and the circuit board 24. Alternatively, the dimmer circuit 30 may be mounted on the circuit board 24 with the light sources 14, or may be an integral part of a power supply.

Along these lines, a further aspect of the disclosure relates to methods for controlling power supplied to light sources of a luminaire. One method includes the steps of supplying power to at least one light source, sensing an ambient temperature, determining when the ambient temperature passes a threshold ambient temperature, and reducing the power supplied to the at least one light source when the ambient temperature passes the threshold ambient temperature. The step of sensing an ambient temperature is performed by circuitry in communication with the power supply, or, more specifically, a dimmer circuit as described in detail above. The method may further include the step of dissipating heat. A heat sink thermally connected to one or both of the at least one light source and the power supply dissipates the heat.

The step of reducing the power supplied to the at least one light source occurs when the sensed ambient temperature rises above the threshold ambient temperature in order to limit adverse effects on the at least one light source due to heat. Alternatively, the step of reducing the power supplied to the at least one light source occurs when the sensed ambient temperature falls below the threshold ambient temperature in order to improve the efficiency of the luminaire. It should be appreciated that the step of reducing the power in this alternate method does not reduce the output of the light sources which remains substantially constant despite the limited power supplied. This is due to the lower ambient temperatures.

Even more, the step of reducing the power supplied to the at least one light source may be done in a linear manner by linearly reducing the power supplied in relation to the ambient temperature after the ambient temperature passes the threshold ambient temperature, or may done in a digital manner by step-wise reducing the power supplied dependent upon the ambient temperature after the ambient temperature passes the threshold ambient temperature.

Figure 6:
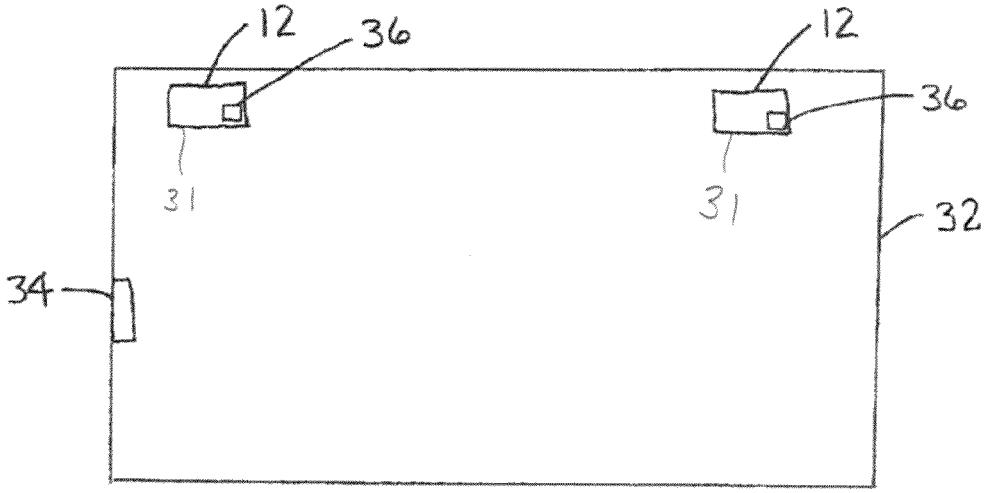
FIG. 6 is a schematic diagram illustrating a system including a luminaire.

Reference is now made to FIG. 6, which illustrates two fixtures 12 in a building 32 or like area. The fixtures 12 may include the features described above or otherwise, and there may be one or more fixtures in a given building 32. An ambient temperature within or adjacent the fixtures 12 is sensed by a thermal sensor 31 associated therewith and compared to an ambient temperature apart from the fixtures sensed by a second thermal sensor 34. The first thermal sensor may be mounted to one of a power supply, a heat sink, a compartment housing the power supply, or the fixture 12. Additionally, the first thermal sensor may be mounted to an exterior surface of the fixture 12 or adjacent the fixture. The second thermal sensor 34 is mounted within the building 32 apart from the fixture 12. A difference between the sensed internal or adjacent, and distant ambient temperatures indicates a thermal efficiency of the fixtures 12. In other words, the efficiency of air flow cooling over the fixture 12 can be tested by measuring the temperature delta.

In the instance when the ambient temperature difference is greater than or equal to a certain threshold as determined by a controller, an indication signal may be provided to a user. Whatever the form, the indication would suggest that the heat dissipation structures or heat sinks, such as fins 12*b*, require maintenance or cleaning. An indication signal, for example, could be provided through a light 36 mounted to a fixture 12 or elsewhere in the building 32. Alternatively, any type of communication channel (e.g., radio frequency, infrared signals, WiFi, and BLUETOOTH® technology or the like) could be used to provide the indication. Other means of providing an indication may likewise be used in accordance with the broad scope of the invention.

The foregoing descriptions of various inventions/embodiments have been presented for purposes of illustration and description. These descriptions are not intended to be exhaustive or to limit the invention to the precise forms disclosed. The embodiments described provide the best illustration of the inventive principles and their practical applications to thereby enable one of ordinary skill in the art to utilize the invention in various embodiments and with various modifications as are suited to the particular use contemplated.

The invention claimed is:

1. A luminaire, comprising:

a fixture including at least one light source;

a power supply mounted to the fixture for supplying power to the at least one light source; and circuitry in communication with the power supply for reducing the power supplied to the at least one light source when an ambient temperature falls below a threshold ambient temperature.

2. The luminaire of claim 1, wherein the circuitry in communication with the power supply is mounted to or near one of the power supply, the fixture, and a circuit board supporting the at least one light source.

3. The luminaire of claim 1, wherein an output of the at least one light source remains substantially constant despite the limited power supplied to the at least one light source due to the ambient temperature.

4. The luminaire of claim 1, wherein the circuitry includes a dimmer circuit.

5. The luminaire of claim 1, wherein the dimmer circuit includes a fixed resistor and a variable resistor having a temperature dependent resistance.

6. The luminaire of claim 5, wherein values of the fixed resistor and the variable resistor are selected such that the power supplied to the at least one light source is reduced when the ambient temperature falls below the threshold ambient temperature.

7. The luminaire of claim 5, wherein the variable resistor is a thermistor.

8. The luminaire of claim 4, wherein the dimmer circuit is mounted on a printed circuit board.

9. The luminaire of claim 4, wherein the dimmer circuit is an integral part of the power supply.

10. The luminaire of claim 7, wherein values of the fixed resistor and the variable resistor are selected such that the power supplied to the at least one light source is reduced when the ambient temperature rises above the threshold ambient temperature.

11. The luminaire of claim 1, wherein the power supply is an inverter.

12. The luminaire of claim 1, wherein the power supply provides a constant current to the at least one light source.

13. The luminaire of claim 1, wherein the power supply and the circuitry in communication with the power supply are positioned within an enclosure mounted to the fixture.

14. The luminaire of claim 1, further comprising a heat sink thermally connected to at least the at least one light source.

15. The luminaire of claim 14, wherein the heat sink is thermally connected to at least the power supply.

16. The luminaire of claim 1, wherein the circuitry in communication with the power supply controls the power supplied to the at least one light source in a linear manner.

17. The luminaire of claim 1, wherein the circuitry in communication with the power supply controls the power supplied to the at least one light source in a digital manner by making a step reduction in the power supplied dependent upon the ambient temperature.

18. A method of controlling power supplied to at least one light source of a luminaire, comprising:

supplying power to the at least one light source;

sensing an ambient temperature; and reducing the power supplied to the at least one light source when the ambient temperature falls below a threshold ambient temperature.

19. A system for indicating when maintenance is required on one or more luminaires in a building comprising:

at least one luminaire;

a thermal sensor mounted to the luminaire for sensing an ambient temperature within or adjacent the luminaire;

a second thermal sensor mounted within the building apart from the at least one luminaire;

a controller for determining a difference between the ambient temperatures sensed by the thermal sensor and the second thermal sensor; and a signal generator providing an indication signal that the determined difference between the ambient temperatures is at or above a threshold difference.

20. A system for testing efficiency of air flow cooling on one or more luminaires in a building comprising:

at least one luminaire;

a thermal sensor for sensing an ambient temperature within or adjacent the luminaire;

a second thermal sensor mounted within the building apart from the at least one luminaire; and a controller for determining a difference between the ambient temperatures sensed by the thermal sensor and the second thermal sensor.

* * * * *